United States Patent [19]

Willis

[11] 4,347,108

[45] Aug. 31, 1982

[54] ELECTRODEPOSITION OF COPPER, ACIDIC COPPER ELECTROPLATING BATHS AND ADDITIVES THEREFOR

[75] Inventor: William J. Willis, North Royalton, Ohio

[73] Assignee: Rohco, Inc., Cleveland, Ohio

[21] Appl. No.: 268,645

[22] Filed: May 29, 1981

[51] Int. Cl.[3] ..... C25D 3/38

[52] U.S. Cl. ..... 204/52 R; 204/DIG. 2; 252/182.1

[58] Field of Search ..... 204/52 R, 44, 106, 123, 204/DIG. 2; 252/182.1

[56] References Cited

U.S. PATENT DOCUMENTS

| | | | |
|---|---|---|---|
| 3,798,138 | 3/1974 | Ostrow et al. | 204/52 R |
| 4,134,803 | 1/1979 | Eckles et al. | 204/52 R |

*Primary Examiner*—G. L. Kaplan

*Attorney, Agent, or Firm*—Maky, Renner, Otto & Boisselle

[57] ABSTRACT

Aqueous acidic copper plating baths and processes for electrodepositing bright and level copper coatings are described. In addition to containing one or more bath-soluble copper salts, free acid and chloride ions, the copper plating baths of the invention contain a brightening compound and a heterocyclic nitrogen or sulfur-nitrogen compound. The brightener compounds are prepared by reacting a mixture of (a) a disulfide having the formula $$[RR'NCS_2]_2 \qquad \text{(Formula I)}$$

wherein R and R′ are each independently hydrogen, alkyl or aryl groups, (b) a halo hydroxy sulfonic acid having the formula $$X(CH_2)_nCH(OH)CH_2SO_3M \qquad \text{(Formula II)}$$

wherein X is a halogen, n is 1 or 2 and M is hydrogen or an alkali metal, and (c) an aliphatic aldehyde having up to 3 carbon atoms in (d) an aqueous alkaline medium.

The heterocyclic compound may be 2-thiazolidinethione or its lower alkyl derivatives, 2-imidazolidinethione or its lower alkyl derivatives, and bath-soluble reaction products of these thione compounds with an alkyl aldehyde or dialdehyde.

23 Claims, No Drawings

ELECTRODEPOSITION OF COPPER, ACIDIC COPPER ELECTROPLATING BATHS AND ADDITIVES THEREFOR

BACKGROUND OF THE INVENTION

This invention relates to aqueous acidic copper plating baths, and more particularly, to aqueous acidic copper plating baths capable of depositing bright and level copper deposits over a wide current density range.

Acid copper plating baths for producing a brilliant copper finish on articles have been known in the art, and a number of patents have described various brightening agents which can be added to acidic baths. Examples of such patents include U.S. Pat. Nos. 2,707,166, 2,707,167, 2,830,014, 3,276,979 and 3,288,690. In U.S. Pat. No. 3,725,220, it has been suggested that the utilization of organic sulfonates or carboxylates as brightening additives in acid aqueous copper plating baths results in improved stability of the bath and effective deposition of copper over a satisfactory current density range.

In a number of instances in the prior art acid copper plating baths, a sufficiently brilliant finish is obtained but little or no smoothing effect on the surface is obtained. The ability of a plating bath to produce deposits relatively thicker in small recesses and relatively thinner on small protrusions thereby decreasing the depth of surface irregularities is known as "leveling." For example, a copper plating bath with satisfactory leveling ability can be utilized to reduce or eliminate the effect of microscopic cracks or scratches on the surfaces of the articles being plated. Accordingly, a number of additives have been described in the prior art for increasing the leveling effect of acid copper plating baths. For example, U.S. Pat. No. 3,101,305 describes a leveling additive obtained from the condensation of thiourea with aliphatic aldehyde such as formaldehyde. Since the additives which have been described in the prior art are useful either as brightening agents or leveling agents, it generally has been necessary to utilize two additives in acid copper plating baths, one for brighteners and another for leveling. U.S. Pat. No. 4,038,161 is an example of a patent which describes the use of two additives in acid copper plating baths. One type of brightener compound disclosed in U.S. Pat. No. 4,038,161 to be used in combination with a leveling agent is the dithiocarbamic acid derivatives of the formula $$R_1R_2NCS_2—(CH_2)_n—X$$

wherein $R_1$ and $R_2$ are hydrogen, aliphatic or aromatic groups, n is an integer from one to ten, and X is a hydroxyl group, a carboxyl group, a sulfonic acid group or an alkali metal salt of the carboxyl or sulfonic acid groups. U.S. Pat. No. 3,414,493 also describes brightener compositions for copper plating baths, and one of the types of brightener composition can be presented by the formula $$R_3R_4NCS_2CH_2O(CH_2)_nSO_3M$$

wherein $R_3$ and $R_4$ are alkyl radicals, n is an integer from 3 to 8, and M is hydrogen, sodium or potassium.

U.S. Pat. No. 4,134,803 describes nitrogen and sulfur compositions for use in acid copper plating baths which are prepared by reacting a mixture of (a) a disulfide having the formula $$[RR'NCS_2]_2 \qquad \text{(Formula I)}$$

wherein R and R' are each independently hydrogen, alkyl or aryl groups, and (b) a halo hydroxy sulfonic acid having the formula $$X(CH_2)_nCHOH—CH_2SO_3M \qquad \text{(Formula II)}$$

wherein X is a halogen, n is one or two and M is hydrogen or an alkali metal, and (c) an aliphatic aldehyde having up to 3 carbon atoms in (d) an aqueous alkaline medium.

These compositions are effective particularly as leveling and brightening agents for acid copper plating baths, and when incorporated into copper plating baths, result in an improved level and bright copper deposit over a wide current density range.

In U.S. Pat. No. 3,798,138, acid copper plating baths are described which contain a mixture of (I) water-soluble organic leveling compounds which may be (a) 2-thiazolidinethione and its lower alkyl derivatives, (b) water-soluble 2-imidazolidinethione and its lower alkyl derivatives, or (c) water-soluble reaction products of (a) or (b) with from about 1 to 10 moles of an alkyl aldehyde or dialdehyde and (II) a brightener composition containing in its molecule (a) an acrylic carbon-sulfur group in which the carbon atoms is attached to at least one other hetero-atom selected from the group consisting of sulfur and oxygen and (b) a water-solubilizing group.

SUMMARY OF THE INVENTION

Aqueous acidic copper electroplating baths are described which contain as essential ingredients:

(A) one or more bath-soluble copper salts, (B) free acid, (C) chloride ions, (D) an effective amount of one or more bath-soluble nitrogen and sulfur-containing brightening compounds prepared by reacting a mixture of (a) a disulfide having the formula $$[RR'NCS_2]_2 \qquad \text{(Formula I)}$$

wherein R and R' are each independently hydrogen, alkyl or aryl groups, (b) a halo hydroxy sulfonic acid having the formula $$X(CH_2)_nCH(OH)CH_2SO_3M \qquad \text{(Formula II)}$$

wherein X is a halogen, n is one or two and M is hydrogen or an alkali metal, (c) an aliphatic aldehyde having up to three carbon atoms in, (d) an aqueous alkaline medium, and (E) one or more heterocyclic sulfur-nitrogen compounds selected from the group consisting of (e) 2-thiazolidinethione and its lower alkyl derivatives, (f) 2-imidazolidinethione and its lower alkyl derivatives, and (g) bath-soluble reaction products of (e) or (f) with an alkyl aldehyde or dialdehyde.

The plating baths preferably also contain a wetting agent or surface-active agent. The acid copper plating baths of the invention produce a lustrous smooth and level deposit of copper over a wide range of current densities for an extended period of use.

DESCRIPTION OF THE PREFERRED EMBODIMENTS

The nitrogen and sulfur brightening compositions used in the baths of the invention are prepared by reacting a mixture of a disulfide, a halo hydroxysulfonic acid and an aliphatic aldehyde in the presence of an aqueous alkaline medium. The disulfides which are useful have the formula $$[RR'NCS_2]_2 \qquad \text{(Formula I)}$$

wherein R and R′ are each independently hydrogen, alkyl or aryl groups. The alkyl groups may contain from 1 to about 5 carbon atoms although alkyl groups containing 1 or 2 carbon atoms are preferred. In a more preferred embodiment, both R and R′ are alkyl groups containing 1 or 2 carbon atoms, that is, the disulfide is either bis(dimethylthiocarbamoyl) disulfide or bis(diethylthiocarbamoyl) disulfide.

The halo hydroxysulfonic acids utilized in the preparation of the brightener compositions have the formula $$X(CH_2)_nCH(OH)—CH_2SO_3M \qquad \text{(Formula II)}$$

wherein X is a halogen, n is one or two and M is hydrogen or an alkali metal. Examples of sulfonic acids represented by Formula II include 3-chloro-2-hydroxypropyl sulfonic acid; 3-bromo-2-hydroxypropyl sulfonic acid; 4-chloro-2-hydroxybutyl sulfonic acid; 4-bromo-2-hydroxybutyl sulfonic acid; and the alkali metal salts of the sulfonic acids such as sodium 3-chloro-2-hydroxypropyl sulfonate. The sodium salts of the chlorosulfonic acids preferably are used in the reaction mixture since these are commercially available or easily prepared.

The aliphatic aldehyde included in the mixture may contain up to about 3 carbon atoms and may be formaldehyde, acetaldehyde or propionaldehyde. Formaldehyde or paraformaldehyde are preferred examples of the aliphatic aldehydes which are useful in the preparation of these brightener compositions. The aliphatic aldehyde is charged to the reaction mixture prior to heating to the reflux temperature. The amount of aliphatic aldehyde incorporated into the mixture may be varied, but it is preferred that about 1 mole of aliphatic aldehyde be included in the mixture containing about 0.5 mole of the disulfide.

The above described thiocarbamoyl disulfides, halo hydroxysulfonic acids and aldehydes are reacted in an aqueous alkaline medium. The aqueous medium may be either water or a water:alcohol mixture wherein the alcohol may be methanol, ethanol, propanol, etc. The aqueous medium contains an alkali metal hydroxide such as sodium hydroxide or potassium hydroxide.

The amounts of the above compounds used in the reaction mixture can be varied. A preferred embodiment utilizes a mixture of disulfide, sulfonic acid, aliphatic aldehyde and alkali metal hydroxide in a molar ratio of about 0.5:1:1:1. The reaction mixture containing the aliphatic aldehyde is refluxed for a period of time which depends also on the type of reactants included in the mixture. Generally, from about 0.5 to about 5 or 6 hours at the reflux temperature of the mixture is sufficient to insure complete reaction.

A description of the preparation and examples of these types of brightener compositions used in the plating baths of the invention can be found in U.S. Pat. No. 4,134,803. Unless otherwise indicated, all parts and percentages are by weight.

EXAMPLE 1

A mixture of 14.8 parts of bis(N,N-diethylthiocarbamoyl) disulfide, 4.0 parts of sodium hydroxide, 8.2 parts of formaldehyde, 19.7 parts of the sodium salt of 3-chloro-2-hydroxypropyl sulfonic acid and 65 parts of water is prepared, stirred and heated to the reflux temperature for about 4 hours. The reaction product is cooled and diluted with water or a water methanol mixture as desired.

EXAMPLE 2

The procedure of Example 1 is repeated except that the disulfide used in this example is bis(N,N-dimethylthiocarbamoyl) disulfide.

EXAMPLE 3

The procedure of Example 1 is repeated except that the propyl sulfonic acid salt is replaced by an equivalent amount of the sodium salt of 4-chloro-2-hydroxybutyl sulfonic acid.

EXAMPLE 4

The producure of Example 1 is repeated except that the formaldehyde is replaced by an equivalent amount of acetaldehyde.

The heterocyclic sulfur-nitrogen compounds which are utilized in the copper plating baths of the present invention are (e) 2-thiazolidinethione and its lower alkyl derivatives, (f) 2-imidazolidinethione and its lower alkyl derivatives, and (g) bath-soluble reaction products of (e) or (f) with an alkyl aldehyde or dialdehyde. The lower alkyl derivatives generally are the methyl and ethyl derivatives, and the degree of substitution that can be made is limited by the solubility of the substituted product in the acid copper plating baths. The substituted compounds can be made more soluble in the plating bath by first dissolving the compound in sulfuric acid, alcohol or sodium hydroxide. The tautomeric form of 2-thiazolidinethione, namely, 2-mercapto thiazoline can be utilized as a component of the copper plating baths of the invention.

The compounds of type (g) are produced by reacting the heterocyclic sulfur-nitrogen compounds with an alkyl aldehyde or dialdehyde wherein the alkyl radical has 1 to 10 carbon atoms. The molar ratio of the two types of heterocyclic sulfur-nitrogen compounds to aldehyde used for the reaction can be varied from about 1:1 to about 1:10, and preferably, the molar ratio is maintained between about 1:1.5 and 1:2. Examples of aldehydes that are useful in the reaction include formaldehyde, acetaldehyde, adipaldehyde, etc. An example of a dialdehyde is glyoxal. The reactions between the aldehydes and dialdehydes with the heterocyclic compounds generally are carried out at a temperature range of from about 65° to about 100° C. At these temperatures, the reactions proceed relatively rapidly as indicated by a change in the color of the reaction mixture.

Only a relatively small amount of the heterocyclic sulfur-nitrogen compounds is required in the acid copper plating baths of the invention, and concentrations as low as 0.0001 grams per liter are effective. Generally, about 0.0005 grams per liter or more should be included in the plating baths of the invention.

The conventional acid copper plating baths to which the above-described compositions are added should normally contain one or more bath-soluble copper salts, free acid and chloride ions. Copper sulfate, $CuSO_4.5H_2O$ is most often utilized as a source of copper, while sulfuric acid is the most common source of free acid. Other acids which have been utilized in the art include sulfamic or fluoboric acids, and the copper may be combined with an acid as copper carbamate or as a salt of sulfamic or fluoboric acid. The concentration of copper salt may be within the range of from about 40 to about 250 gms. and the free acid concentration can be between 45 to about 200 gms. per liter of plating bath. In addition, the baths often will contain from about 0.01 to about 0.1 gm. of chloride ions per liter of plating bath, added to the bath as hydrochloric acid.

The amount of the brightener (D) and heterocyclic sulfur-nitrogen compositions (E) incorporated into the copper plating baths of the invention will be those amounts required to provide the desired bright and level deposit. In general, the amount of the brightener will range from about 0.001 to about 1.0 gm. per liter, although a range of from about 0.01 gm. to about 0.15 gm. per liter provides desirable bright and level deposits. Lesser amounts of the heterocyclic sulfur-nitrogen compositions are required in the baths and amounts as little as 0.0001 gm. per liter, more often 0.0005 gm. per liter are useful in improving the properties of the baths. More than 1 gm. per liter of the heterocyclic compound is not generally used in the bath. The incorporation of the heterocyclic sulfur-nitrogen compositions in combination with the above-described brightener compositions results in baths which deposit improved bright and level copper coatings over a wide current density range, and the bath continues to deposit acceptable coatings for longer periods of time.

The incorporation of one or more wetting or surface active agents into the additive compostions and acid copper plating baths of the invention also results in a copper plating with improved leveling and brightness, and the additive compositions and plating baths exhibit improved stability.

Polyoxyalkylated naphthols are one type of wetting agent found to be useful in improving the quality of the copper deposits. Amounts of the substituted naphthol of up to about 1 gm. per liter and preferably from about 0.2 to about 0.8 gm. per liter provide improved copper deposits.

The polyoxyalkylated naphthols useful in the baths of this invention are obtained by reacting a naphthol with an alkylene oxide such as ethylene oxide and propylene oxide and more particularly, with from about 6 to about 40 moles of ethylene oxide per mole of naphthol. The naphthol reactant may be either $\alpha$- or $\beta$-naphthol and the naphthalene rings may contain various substituents such as the alkyl groups or alkoxy groups, especially lower alkyl and lower alkoxy groups of up to seven carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula (Formula III)

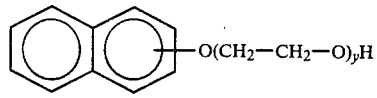

wherein y is from about 6 to about 40 and preferably from about 8 to about 20.

Wetting agents based on ethylene oxide, for example, polyglycol compounds and the like; and sulfonated wetting agents also are useful. In general, the nonionic wetting agents such as those containing ether linkages are particularly useful additives. Examples of such ether-containing wetting agents are those having the general formula $$R—O—(CH_2CH_2O)_nH$$

wherein R is an aryl or alkyl group containing from about six to 20 carbon atoms and n is an integer between 2 and 100. Such wetting agents are produced generally by treating fatty alcohols or alkyl-substituted phenols with excess ethylene oxide. The alkyl carbon chain may contain from about 14 to 24 carbon atoms and may be derived from alcohol such as oleyl alcohol or stearyl alcohol.

Amine, alkanol amines, amides and polyglycol-type wetting agents known in the art are also useful. Carbowax-type wetting agents which are polyethylene glycols having different molecular weights have been found to give good results. For example, Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention.

Other examples of wetting agents are the non-ionic polyoxyalkylene compounds selected from the compounds of the formula (Formula IV)

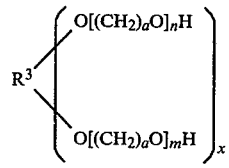

wherein the sum of m+n is at least 10, a is 2 or 3, x is 1 or 2 and the compound is derived (1) from a reaction of ethylene oxide (a=2) with a polyol selected from the group consisting of polyoxypropylene glycol of a molecular weight of at least about 300 or N,N,N',N-tetrakis (polyoxypropylene glycol) alkyene diamine of a molecular weight of at least about 500, or (2) from a reaction of propylene oxide (a=3) with a polyol selected from the group consisting of polyoxyethylene glycol of a molecular weight of at least about 300 or N,N,N',N'-tetrakis (polyoxyethylene glycol) alkylene diamine having a molecular weight of at least 500, and $R^3$ is defined by the selected polyol.

One type of non-ionic polyoxyalkylene compound which is found to be useful in the copper plating baths of the invention are the block copolymers of ethylene oxide and propylene oxide based on a glycol such as ethylene glycol or propylene glycol. The copolymers based on propylene glycol generally are prepared by forming a hydrophilic base by reaction of propylene oxide with propylene glycol to form an intermediate product which then is condensed with ethylene oxide. The molecular weight of the intermediate product generally is at least about 300. Copolymers of this type can be represented by the following formula $$HO—(C_2H_4O)_b(C_3H_6O)_c(C_2H_4O)_d—H \qquad \text{(Formula V)}$$

wherein b, c and d are integers, the sum of b and d is at least about 10, and c is at least about 5.

The copolymers based on ethylene glycol similarly are prepared by reaction of ethylene glycol followed by condensation of the intermediate product with propylene oxide. The intermediate product generally will have a molecular weight of at least about 300. The copolymers based on ethylene glycol generally can be represented by the following formula $$HO—(C_3H_6O)_e(C_2H_6O)_f(C_3H_4O)_g—H \qquad \text{(Formula VI)}$$

wherein e, f and g are integers, the sum of e and g is at least about 10, and f is at least about 5.

By varying the proportions of the oxides and glycols used to form the above copolymers, the properties may be varied. Both of the above types of copolymes (Formulas V and VI) are available commercially such as from BASF Wyandotte under the general trademark PLURONIC. The condensates based on ethylene glycol are identified as the "R" series, and these compounds preferably contain from about 30% to about 80% of polyoxyethylene in the molecule and may be either liquids or solids. The condensates based on propylene glycol are identified generally by BASF Wyandotte as the "F," "L" or "P" series, and these may contain from about 5% to about 80% of ethylene oxide. The "L" series of propylene glycol based copolymers are liquids, and "F" series are solids and the "P" series are pastes. The solids and pastes can be used when they are soluble in the bath formulation (or as mentioned below, in the aqueous rinse). The molecular weights of these block copolymers range from about 400 to about 14,000 and more preferably from about 2000 to about 8000. The propylene glycol based copolymer available from BASF Wyandotte under the designation "PLURONIC L-64" is a particularly preferred example of a non-ionic polyoxyalkylene compound useful in the plating bath (and, as mentioned below, in the aqueous rinse).

The preparation of the non-ionic polyoxyalkylene compounds represented by Formulas V and VI is well known in the art. For example, procedures are described in Schwartz, Perry & Berch, *Surface Active Agents and Detergents,* Vol. II, Interscience Publishing (1958), pages 163–166; Moilliet, Collie & Black, Van Nostrand (1961), pages 474–8; and the *Encyclopedia of Polymer Science and Technology,* Vol. 6 (1967), pages 103–209.

The non-ionic polyoxyalkylene compounds also may be derived by the reaction of ethylene or propylene oxide with an alkylene diamine followed by the addition of propylene oxide or ethylene oxide, the oxide of the second addition being different from the initial oxide reacted with the diamine. The non-ionic compoundsof this type generally can be represented by the formula (Formula VII)

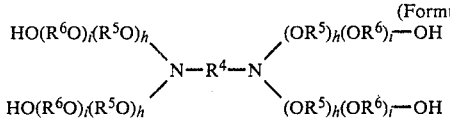

wherein h and i are integers, $R^4$ is a lower alkylene group, and $R^5$ and $R^6$ are ethylene or propylene groups with the proviso that $R^5$ and $R^6$ are different.

Generally the sum of i on each nitrogen is at least about 10, and $R^4$ preferably is an ethylene group.

Compounds of the type represented by Formula VII wherein $R^5$ are ethylene groups and $R^6$ are propylene groups are prepared by the reaction of propylene oxide with N,N,N′,N′-tetrakis (polyoxyethylene glycol) ethylene diamine. The compound of Formula VII wherein each $R^5$ is a propylene group and each $R^6$ is an ethylene group is obtained by reacting ethylene oxide with N,N,N′,N′-tetrakis (polyoxypropylene glycol) ethylene diamine. In both of these examples, the ethylene diamine generally will have a molecular weight of at least about 500.

A series of non-ionic polyoxyalkylene compounds of the type represented by Formula VII wherein each $R^5$ is a propylene group and each $R^6$ is an ethylene group are available from BASF Wyandotte Corporation under the general trade designation "TETRONIC". For example, "TETRONIC 707" is believed to be the product obtained by reacting about 46 moles of propylene glycol with N,N,N′,N′-tetrakis ethylene diamine followed by reaction with about 210 moles of ethylene oxide. Other members of the series of compounds available from BASF Wyandotte include TETRONIC 304, TETRONIC 901, TETRONIC 1101 and TETRONIC 1502.

The amount of wetting agent which is incorporated into the acid copper plating baths and concentrates of the invention will depend upon the types and amounts of other ingredients in the compositions, but generally from about 0 to about 5 grams, and preferably from about 0.1 to about 2 grams per liter of the wetting agent may be incorporated into the plating baths.

An example of a conventional acid copper plating bath generally identified as a decorative copper plating bath to which the additives of the invention can be added is as follows:

| CONVENTIONAL BATH NO. 1 | |
|---|---|
| Copper Sulfate ($CuSO_4.5H_2O$) | 210 g/l |
| Sulfuric Acid | 60 g/l |
| Chloride Ion | 60 ppm |
| Water | 730 g/l |

An example of another conventional acid copper plating bath known generally as a low metal, high throw PCB bath to which the additives of the invention can be added is as follows.

| CONVENTIONAL BATH NO. 2 | |
|---|---|
| Copper Sulfate ($CuSO_4.5H_2O$) | 83 g/l |
| Sulfuric Acid | 195 g/l |
| Chloride Ion | 60 ppm |

-continued

| CONVENTIONAL BATH NO. 2 | |
|---|---|
| Water | 722 g/l |

The following specific examples illustrate the aqueous acid copper plating baths of the invention. Unless otherwise indicated, all parts are by weight.

BATH EXAMPLE A

Conventional bath No. 1 (1 liter) to which there is added 0.08 grams of the product of Example 1 and 0.0005 grams of 2-mercapto thiazoline.

BATH EXAMPLE B

The bath of Example A to which there also is added 1.5 grams of polyethylene glycol wetting agent (Carbowax 4000).

BATH EXAMPLE C

The bath of Example A wherein the product of Example 1 is replaced by 0.1 gram of the product of Example 2.

BATH EXAMPLE D

The bath of Example A to which there also is added 1.0 grams of the product of $\beta$-naphthol with 10 moles of ethylene oxide.

BATH EXAMPLE E

Conventional bath No. 2 (1 liter) to which is added 0.1 gram of the product of Example 1 and 0.001 gram of 2-mercapto thiazoline.

BATH EXAMPLE F

The bath of Example E to which there also is added 1.5 grams of Carbowax 4000.

BATH EXAMPLE G

The bath of Example E to which there also is added 1 gram of "PLURONIC L-64" (propylene glycol based copolymer from BASF Wyandotte).

BATH EXAMPLE H

The plating bath of Example A wherein the 2-mercapto thiazoline is replaced by 0.1 gram of 2-imidazolidinethione.

The utility of the above-described copper plating baths is illustrated with a plating test conducted in a 267 ml. air-agitated Hull Cell at an operating current of about 2 amperes for about five minutes at room temperature. Copper is deposited on a scratched brass Hull Cell panel. The copper plating baths of the type described in the examples above produce a bright, smooth and level deposit of copper over a wide current density range of between 100 to 2 amps/foot. sq.

The copper plating baths of the invention can be utilized to produce bright and level copper deposits on all types of metals and alloys, for example, on iron, zinc die-cast, copper and brass. In practice, the improved acid copper plating baths of the invention can be operated on a continuous or intermittent basis. From time to time, the components of the bath have to be replenished. Various components can be added singularly as required, or may be added in combination. The amounts of the various ingredients to be added to the plating baths can be varied over a wide range depending on the nature and performance of the copper plating bath to which the ingredients are added. Such amounts can be determined readily by those skilled in the art.

The combination additive compositions for acid copper plating baths within the present invention comprise an aqueous or water: alcohol mixture of (a) one or more bath-soluble brightening compounds of the type described above, (b) one or more heterocyclic sulfur-nitrogen compounds of the type described above, and optionally (c) one or more wetting agents of the types described above. An example of such additive composition is a combination which comprises from about 10 to about 20 parts by weight of the brightening composition, from about 0.1 to about 2 parts by weight of the heterocyclic sulfur-nitrogen compound, and from about 2 to about 20 parts by weight of one or more wetting agents, preferably dissolved in water. In practice, the amounts of the ingredients in the additive composition of concentrates will be such that when they are diluted and added to the baths, they will provide the requisite amounts of components in the bath or the requisite amounts of the components required to replenish the bath.

What is claimed is:

1. An aqueous acidic copper electroplating bath containing as essential ingredients:

(A) one or more bath-soluble copper salts, (B) free acid, (C) chloride ions, (D) an effective amount of one or more bath-soluble nitrogen and sulfur-containing brightening compounds prepared by reacting a mixture of (a) a disulfide having the formula $$[RR'NCS_2]_2 \quad \text{(Formula I)}$$

wherein R and R' are each independently hydrogen, alkyl or aryl groups, (b) a halo hydroxy sulfonic acid having the formula $$X(CH_2)_nCH(OH)CH_2SO_3M \quad \text{(Formula II)}$$

wherein X is a halogen, n is one or two and M is hydrogen or an alkali metal, (c) an aliphatic aldehyde having up to three carbon atoms in (d) an aqueous alkaline medium, and (E) one or more heterocyclic sulfur-nitrogen compounds selected from the group consisting of (e) 2-thiazolidinethione and its lower alkyl derivatives, (f) 2-imidazolidinethione and its lower alkyl derivatives, and (g) bath-soluble reaction products of (e) or (f) with an alkyl aldehyde or dialdehyde.

2. The copper plating bath of claim 1 wherein R and R' in the disulfide (a) are each independently alkyl groups containing from 1 to about 5 carbon atoms.

3. The copper plating bath of claim 1 wherein X is chlorine and n is 1 in Formula II.

4. The copper plating bath of claim 1 wherein the aliphatic aldehyde (c) is formaldehyde or paraformaldehyde.

5. The copper plating bath of claim 1 wherein the aqueous alkaline solution (d) comprises an alkali metal hydroxide dissolved in water or an alcohol:water mixture.

6. The copper plating bath of claim 1 wherein the mole ratio of disulfide to sulfonic acid to aldehyde to hydroxide is about 0.5:1:1:1.

7. The copper plating bath of claim 1 wherein the heterocyclic compound (E) is 2-thiazolidinethione or its lower alkyl derivatives.

8. The copper plating bath of claim 1 wherein the brightening compound (D) is present in the bath in an amount of from about 0.0001 to about 1.0 gram per liter.

9. The copper plating bath of claim 1 wherein the bath also contains (F) at least one wetting or surface active agent.

10. The copper plating bath of claim 9 wherein the wetting agent is a polyalkylene glycol, a polyalkylene glycol ether, a composition prepared by addition of propylene oxide to ethylene diamine followed by the addition of ethylene oxide, or mixtures thereof.

11. The copper plating bath of claim 10 wherein the wetting agent is a polyethylene oxide having a molecular weight of from about 400 to about 6,000.

12. The copper plating bath of claim 9 wherein the wetting agent is a polyoxyalkylated naphthol.

13. The copper plating bath of claim 1 wherein the heterocyclic sulfur-nitrogen compound is 2-mercapto thiazoline.

14. An aqueous acid copper electroplating bath for producing bright and level copper deposits comprising per liter of bath from about (A) 40 to about 250 grams of copper sulfate.
(B) 45 to about 200 grams of sulfuric acid,
(C) 0.01 to about 0.1 gram of chloride ion
(D) 0.001 to about 1.0 gram of one or more bath-soluble brightening compounds prepared by reacting a mixture of
(a) a disulfide having the formula $$[RR'NCS_2]_2 \quad \text{(Formula I)}$$

wherein R and R′ are each independently hydrogen, alkyl or aryl groups,
(b) a halo hydroxy sulfonic acid having the formula $$X(CH_2)_nCH(OH)CH_2SO_3M \quad \text{(Formula II)}$$

wherein X is a halogen, n is one or two and M is hydrogen or an alkali metal,
(c) an aliphatic aldehyde having up to three carbon atoms in,
(d) an aqueous alkaline medium, and
(E) from about 0.0001 to about 1.0 gram of a heterocyclic sulfur-nitrogen compound selected from the group
(e) 2-thiazolidinethione and its lower alkyl derivatives,
(f) 2-imidazolidinethione and its lower alkyl derivatives, and
(g) bath-soluble reaction products of (e) or (f) with an alkyl aldehyde or dialdehyde, and
(F) 0 to about 2.0 gram of a polyalkylene glycol ether wetting agent.

15. The acid copper plating bath of claim 14 wherein R and R′ in the disulfide (a) are each independently alkyl groups containing from about 1 to about 5 carbon atoms.

16. The copper plating bath of claim 14 wherein X is chlorine and n is 1 in Formula II.

17. The copper plating bath of claim 14 wherein the aliphatic aldehyde (c) is formaldehyde or paraformaldehyde.

18. The copper plating bath of claim 14 wherein the aqueous alkaline solution (d) comprises an alkali metal hydroxide dissolved in water or an alcohol:water mixture.

19. The copper plating bath of claim 14 wherein the heterocyclic sulfur-nitrogen compound (E) is 2-mercapto thiazoline.

20. The acid copper plating bath of claim 14 wherein the wetting agent is a polyethylene glycol having a molecular weight of from about 400 to about 6,000.

21. A method of electrodepositing copper coatings on a substrate which comprises electroplating said substrate in an aqueous acidic bath of any one of claims 1–20.

22. An additive composition for aqueous acidic copper electroplating baths comprising an aqueous mixture of (A) one or more bath-soluble brightening compounds prepared by reacting a mixture of
(a) a disulfide having the formula $$[RR'NCS_2]_2 \quad \text{(Formula I)}$$

wherein R and R′ are each independently hydrogen, alkyl or aryl groups,
(b) a halo hydroxy sulfonic acid having the formula $$X(CH_2)_nCH(OH)CH_2SO_3M \quad \text{(Formula II)}$$

wherein X is a halogen, n is one or two and M is hydrogen or an alkali metal,
(c) an aliphatic aldehyde having up to three carbon atoms in,
(d) an aqueous alkaline medium, and
(B) one or more heterocyclic sulfur-nitrogen compounds selected from the group consisting of
(e) 2-thiazolidinethione and its lower alkyl derivatives,
(f) 2-imidazolidinethione and its lower alkyl derivatives, and
(g) bath-soluble reaction products of (e) or (f) with an alkyl aldehyde or dialdehyde, and
(C) at least one non-ionic wetting agent.

23. The additive composition of claim 22 wherein the wetting agent is a polyalkylene glycol or polyalkylene glycol ether wetting agent.

* * * * *